US006237174B1

(12) United States Patent
Hutchinson

(10) Patent No.: US 6,237,174 B1
(45) Date of Patent: May 29, 2001

(54) CLOTH SLIPPER

(76) Inventor: Janet Hutchinson, 234 Vernon St., Rockland, MA (US) 02370

( * ) Notice: Subject to any disclaimer, the term of this patent is extended or adjusted under 35 U.S.C. 154(b) by 0 days.

(21) Appl. No.: 09/498,746

(22) Filed: Feb. 7, 2000

(51) Int. Cl.[7] ..... A43B 1/02; A43B 23/04

(52) U.S. Cl. ..... 12/142 G; 36/9 R; 36/47; 36/48

(58) Field of Search ..... 36/9 R, 47, 48, 36/49, 10, 9 A, 45; 12/142 G

(56) References Cited

U.S. PATENT DOCUMENTS 2,038,844 * 4/1936 Dorf .
2,041,505 * 5/1936 Woerle .
3,148,378 * 9/1964 Tibbitts .
4,616,429 * 10/1986 Alcala .
5,228,215 * 7/1993 Bayer .
6,023,856 * 2/2000 Brunson et al. .

FOREIGN PATENT DOCUMENTS

1266650 * 6/1961 (FR) .

* cited by examiner

*Primary Examiner*—Ted Kavanaugh
(74) *Attorney, Agent, or Firm*—John P. McGonagle

(57) ABSTRACT

A method of making a slipper from a rectangular blank of terry cloth, a strip of rectangular lace and an elastic strip.

10 Claims, 5 Drawing Sheets

CLOTH SLIPPER

BACKGROUND OF THE INVENTION

This invention relates to cloth slippers, and in particular to a novel construction and a method of making such cloth slippers.

In the past, most cloth slippers have been made from specially shaped blanks requiring special manufacturing processes to prepare the blanks. Where a generally rectangular blank has been used, such as in U.S. Pat. No. 2,041,505, issued on May 19, 1936, to K. F. Woerle, the heel portion has been left open and snap fasteners have been used to temporarily hold a slipper shape.

SUMMARY OF THE INVENTION

The present invention provides a permanent slipper made from a rectangular blank. The slipper of the present invention is economical to make, completely encloses a foot, and has pleasing ornamental embodiments. The blank used is made from a washable fabric and economically manufactured in quantities. The blank used may be a simple wash cloth. An attractive slipper constructed according to the principles of the present invention may be made at home quickly, easily and economically with a minimum of materials and sewing skills.

These together with other objects of the invention, along with various features of novelty which characterize the invention, are pointed out with particularity in the claims annexed hereto and forming a part of this disclosure. For a better understanding of the invention, its operating advantages and the specific objects attained by its uses, reference should be had to the accompanying drawings and descriptive matter in which there is illustrated a preferred embodiment of the invention.

DETAILED DESCRIPTION OF THE INVENTION

Figure 1:
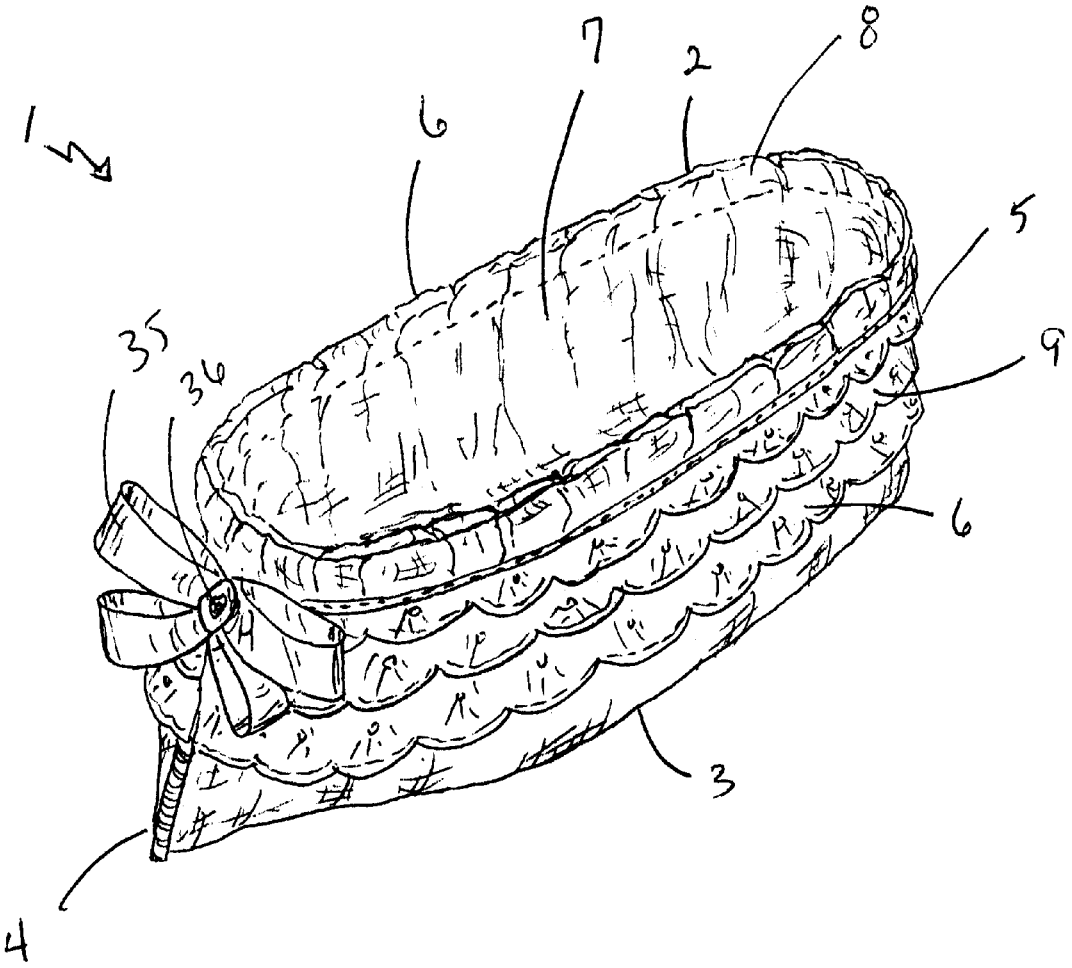
FIG. 1 is an upper frontal perspective view of a cloth slipper constructed according to the principles of the present invention.

Referring to the drawings in detail wherein like elements are indicated by like numerals, there is shown an embodiment of the invention 1 incorporating a cloth slipper. The slipper 1 has a top 2, bottom 3, front toe end 4, rear heal end 5, two sides 6, an interior 7, and a top central opening 8.

Figure 2:
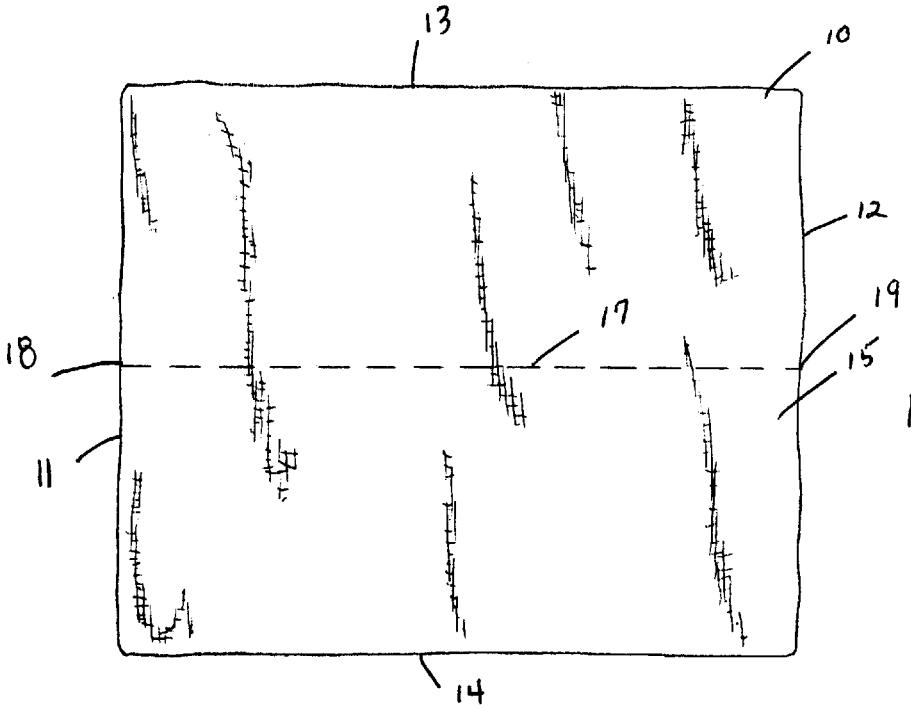
FIG. 2 is a top view of an approximately rectangular fabric blank used in the construction of the cloth slipper of FIG. 1.
Figure 3:
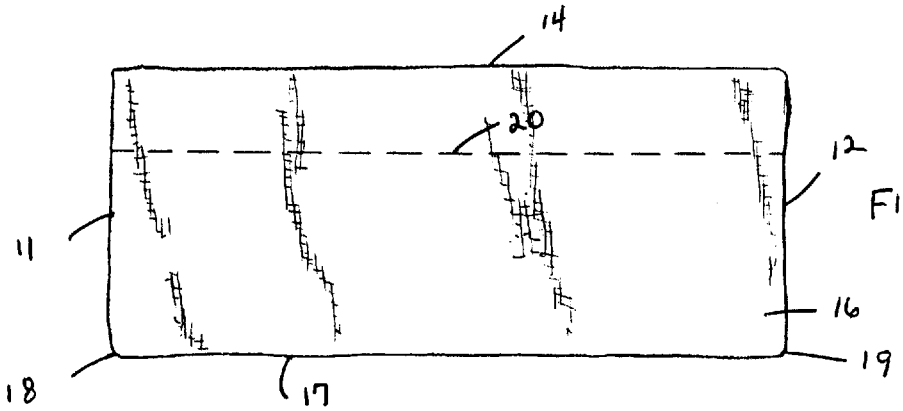
FIG. 3 illustrates a first blank fold in the process of constructing the cloth slipper of FIG. 1.
Figure 4:
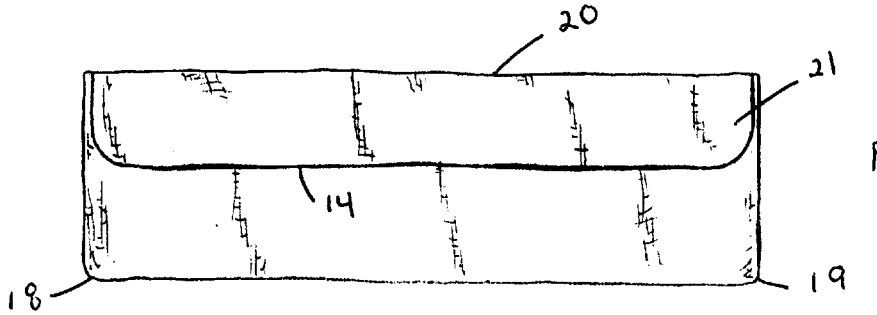
FIG. 4 illustrates a second blank fold thereof.
Figure 5:
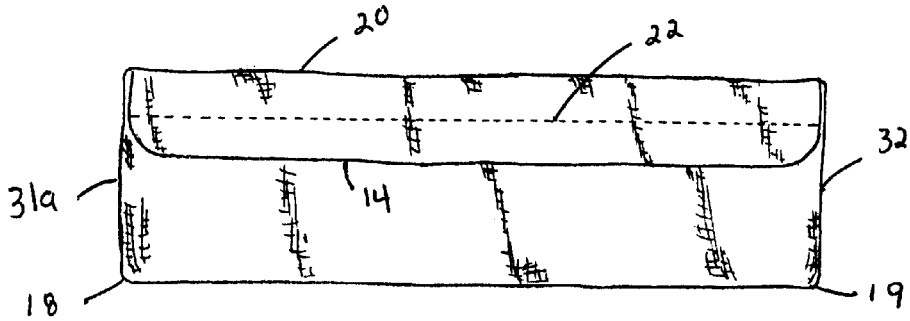
FIG. 5 illustrates a first stitching sequence thereof.
Figure 6:
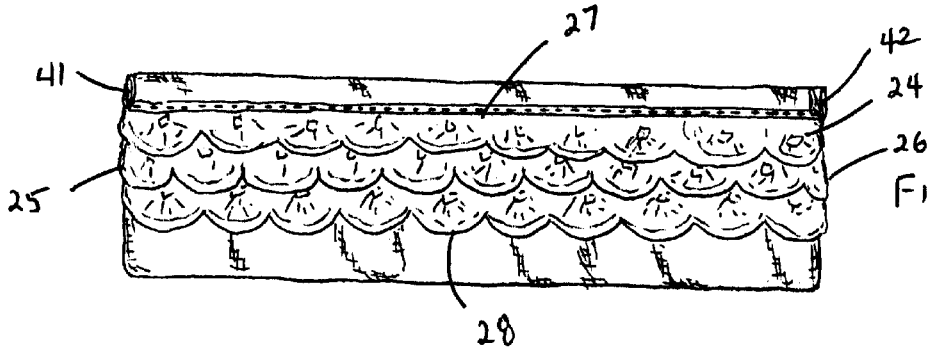
FIG. 6 illustrates the application of a lace skirt thereof.

The slipper 1 is made from a generally rectangular blank 10 of terry cloth with four edges, one of which is designated as the front edge 11, an opposite edge designated as the back edge 12, a side edge designated as the right side edge 13 and the opposite side edge designated as the left side edge 14. In addition to the four edges 11–14, the blank 10 has an upper surface 15 and a lower surface 16. The blank 10 has a central, longitudinal axis 17 extending from the front edge midpoint 18 to the back edge midpoint 19. See FIGS. 1 and 2.

The first step in constructing the slipper 1 is to fold the blank 10 along its central longitudinal axis 17 so that the side edges 13, 14 touch and the blank upper surface 15 is hidden from view and forms the general interior 7 of the slipper 1. Each side edge 13, 14 is then folded back along a side longitudinal axis 20 parallel to each side edge 13, 14, away from each slipper side 6, toward the slipper bottom 3, and then coming to rest against a slipper side 6, thereby forming a flap 21 on each side 6 with a portion of the blank upper surface 15 exposed. Each side longitudinal axis 20 is positioned between ¼ and ⅓ of the distance from its side edge 13, 14 toward the central longitudinal axis 17. Each flap 21 is then stitched to its adjacent side 6 by means of a straight longitudinal row 22 of stitches, said row 22 being positioned along an axis parallel to its respective side edge 13, 14 midway between said side edge 13, 14 and said respective side longitudinal axis 20. A rectangular strip of lace 24 is attached to each flap 21 along the flap row 22 of stitches thereby forming a lace skirt 9 about the top central opening 8. Each lace strip 24 has a forward short side 25, rearward short side 26, upper long side 27 and lower long side 28. Each lace strip 24 is attached to a flap 21 by stitching its upper long side 27 to said flap row 22 of stitches. Each lace strip 24 has a long-side length equal to the distance between the blank front edge 11 and the blank back edge 12. See FIGS. 3, 4, 5 and 6.

Figure 7:
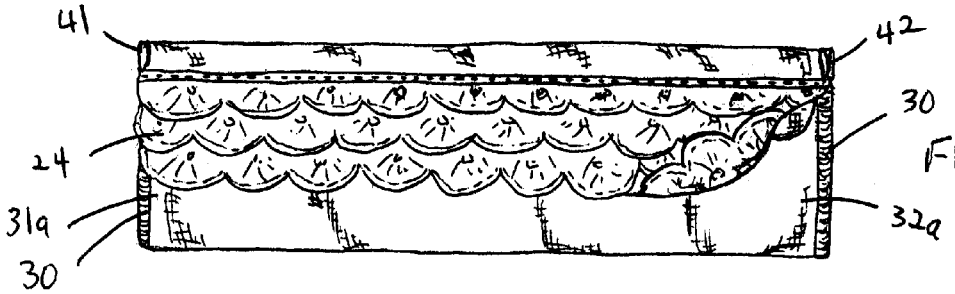
FIG. 7 illustrates a first embroidery sequence thereof.
Figure 8:
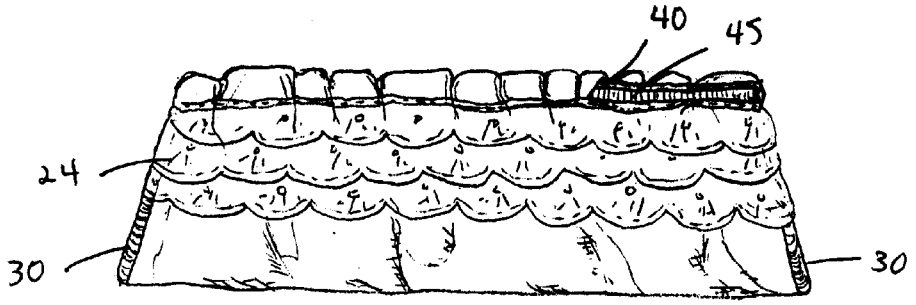
FIG. 8 illustrates the insertion of an elastic strip thereof.
Figure 9:
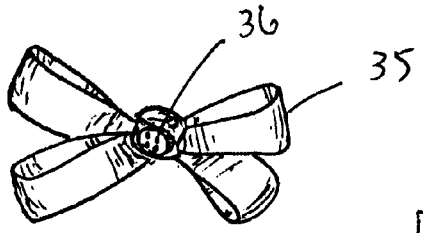
FIG. 9 illustrates a ribbon bow used in the construction of the cloth slipper of FIG. 1.
Figure 10:
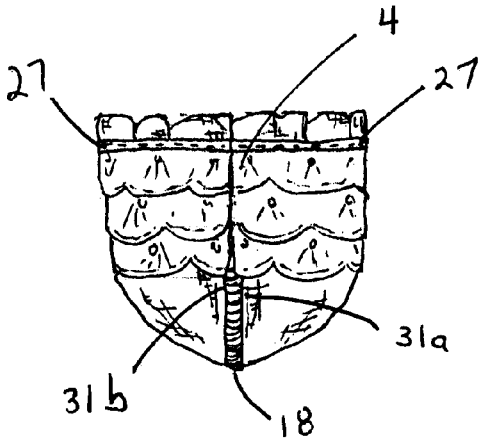
FIG. 10 is a front elevational view showing the toe portion of the cloth slipper without a ribbon bow.
Figure 11:
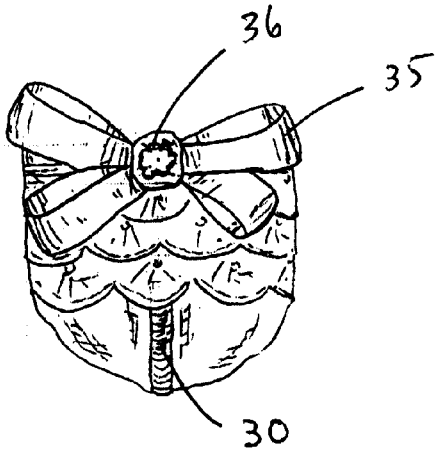
FIG. 11 is a front elevational view showing the toe portion of the cloth slipper with a ribbon bow.
Figure 12:
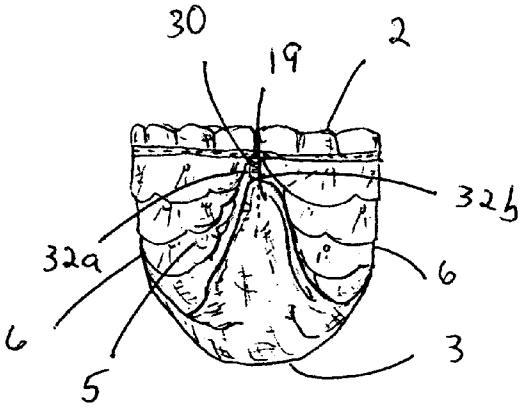
FIG. 12 is a rear elevational view showing the heel portion of the cloth slipper of FIG. 1.
Figure 13:
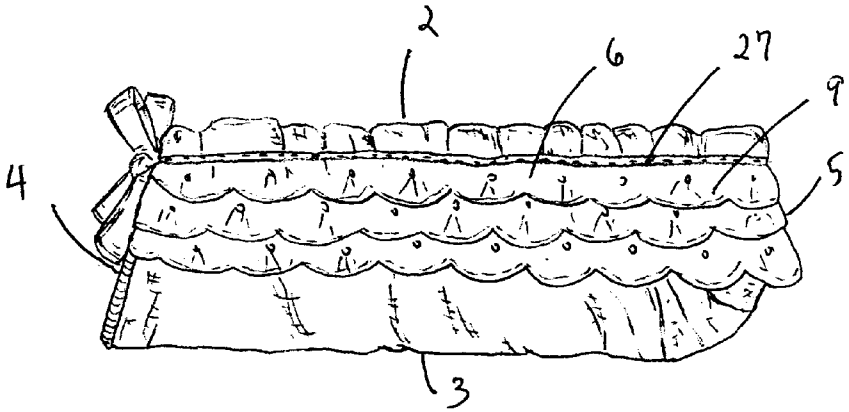
FIG. 13 is a side elevational view thereof.

Those portions 31*a*, 31*b* of the front edge 11 folded on each side of the front edge midpoint 18 and extending to each side flap row 22 of stitches are joined together and attached to each other by means of embroidery stitching 30. Those portions 32*a*, 32*b* of the back edge 12 folded on each side of the back edge midpoint 19 and extending to each side flap row 22 of stitches are joined together and attached to each other by means of embroidery stitching 30. See FIGS. 7 and 10.

The formation of the flaps 21 and consequent stitch row 22 form a channel 40 under each flap 21 between the stitch row 22 and the side longitudinal axis 20. Each channel has an open front end 41 and an open rear end 42. A continuous elastic strip 45 with two ends 46, 47 is inserted, one end 46 first, through both channels 40 and out to be attached to the other end 47 of the elastic strip 45. The two channel open front ends 41 are interconnected with the elastic strip 45 contained therein. The two channel open rear ends 42 are also interconnected thereby completely enclosing the elastic strip 45 within a resulting continuous channel 20. The back edge midpoint 19 is folded upward and attached by tacking to the embroidery-joined portions 32*a*, 32*b* of the back edge 12 near to the rearmost point of the two flap rows 22 of stitches. See FIGS. 7, 8, 10, 12 and 13.

A bow 35 formed from ribbon and having a button 36 or other ornament attached to its center 37 is removably attached to the slipper front 4 at the approximate junction of the channel joined front ends 41. The bow 35 may be attached by hook and pile fasteners to the slipper 1. See FIGS. 1, 9, 11 and 13.

Figure 14:
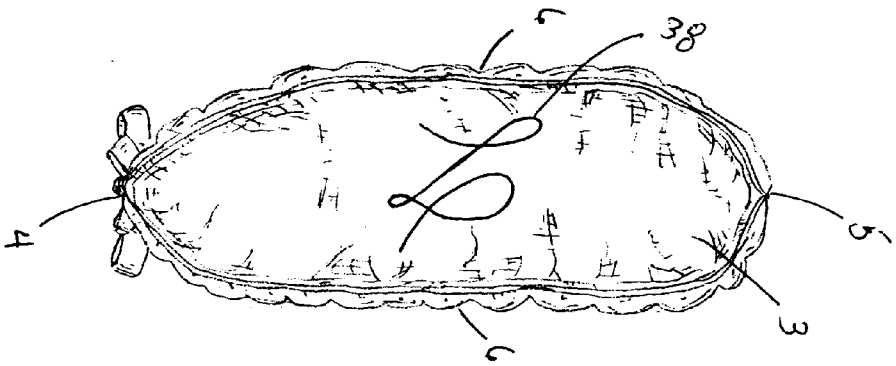
FIG. 14 is a bottom view thereof.

A rubberized, non-skid substance 38 may be applied to the slipper bottom 3 to prevent sliding. This may be in the form of a stylized logo or any other desired pattern. See FIG. 14.

It is understood that the above-described embodiment is merely illustrative of the application. Other embodiments may be readily devised by those skilled in the art which will embody the principles of the invention and fall within the spirit and scope thereof.

I claim:

1. A method of making a cloth slipper having a top, bottom, front toe end, rear heal end, two sides, an interior, and a top central opening, comprising the following steps:

folding a generally rectangular blank having four edges, one of which is designated as the front edge, an opposite edge designated as the back edge, a side edge designated as the right side edge and the opposite side edge designated as the left side edge, said blank having an upper surface and a lower surface, said blank having a central, longitudinal axis extending from the front edge midpoint to the back edge midpoint, along its central longitudinal axis so that the side edges touch and the blank upper surface is hidden from view, said blank upper surface forming the general interior of the slipper;

folding each side edge back along a side longitudinal axis parallel to each side edge, away from each slipper side, toward the slipper bottom, and then coming to rest against a slipper side, thereby forming a flap on each side with a portion of the blank upper surface exposed;

stitching each flap to its adjacent side by means of a straight longitudinal row of stitches, said row being positioned along an axis parallel to its respective side edge midway between said side edge and said respective side longitudinal axis;

attaching a rectangular strip of lace to each flap along the flap row of stitches thereby forming a lace skirt about the top central opening;

joining together and attaching those portions of the front edge folded on each side of the front edge midpoint and extending to each side flap row of stitches;

joining together and attaching those portions of the back edge folded on each side of the back edge midpoint and extending to each flap row of stitches;

wherein the formation of the flaps and consequent stitch row form a channel under each flap between the stitch row and the side longitudinal axis, each said channel having an open front end and an open rear end;

inserting a continuous elastic strip with two ends, one end first, through both channels and out to be attached to the other end of the elastic strip;

interconnecting the two channel open front ends with interconnected with the elastic strip contained therein;

interconnecting the two channel open rear ends thereby completely enclosing the elastic strip within a resulting continuous channel; and folding the back edge midpoint upward and attaching to the joined portions of the back edge near to the rearmost point of the two flap rows of stitches.

2. A method as recited in claim 1, further comprising:

removably attaching an ornament to the slipper front at the approximate junction of the channel joined front ends.

3. A method as recited in claim 2, further comprising:

applying a non-skid substance to the slipper bottom.

4. A method as recited in claim 3, wherein:

each lace strip has a forward short side, rearward short side, upper long side and lower long side, each lace strip being attached to a flap by stitching its upper long side to said flap row of stitches.

5. A method as recited in claim 4, wherein:

each lace strip long-side has a length equal to the distance between the blank front edge and the blank back edge.

6. A method as recited in claim 5, further comprising:

positioning each side longitudinal axis between one quarter and one third of the distance from its side edge toward the central longitudinal axis.

7. A method as recited in claim 6, further comprising:

joining together and attaching those portions of the front edge folded on each side of the front edge midpoint and extending to each side flap row of stitches by means of embroidery stitching.

8. A method as recited in claim 7, further comprising:

joining together and attaching those portions of the back edge folded on each side of the back edge midpoint and extending to each flap row of stitches by means of embroidery stitching.

9. A method as recited in claim 8, wherein:

said ornament is a bow.

10. A method as recited in claim 9, wherein:

said blank is terry cloth.

* * * * *